US011365042B2

(12) United States Patent
Chung

(10) Patent No.: US 11,365,042 B2
(45) Date of Patent: Jun. 21, 2022

(54) BEVERAGE CONTAINER OF DISPENSER TYPE

(71) Applicant: CTK COSMETICS CO., LTD., Seoul (KR)

(72) Inventor: In Yong Chung, Seoul (KR)

(73) Assignee: CTK COSMETICS CO., LTD., Seoul (KR)

( * ) Notice: Subject to any disclaimer, the term of this patent is extended or adjusted under 35 U.S.C. 154(b) by 31 days.

(21) Appl. No.: 17/015,169

(22) Filed: Sep. 9, 2020

(65) Prior Publication Data

US 2022/0048692 A1 Feb. 17, 2022

(30) Foreign Application Priority Data

Aug. 12, 2020 (KR) ..... 10-2020-0101198

(51) Int. Cl.
*B65D 83/00* (2006.01)
*B65D 81/32* (2006.01)
*B65D 85/72* (2006.01)

(52) U.S. Cl.
CPC ..... *B65D 83/0005* (2013.01); *B65D 81/3222* (2013.01); *B65D 85/72* (2013.01)

(58) Field of Classification Search
CPC . B65D 81/3222; B65D 83/0005; B65D 85/72
USPC ..... 222/80, 81–90; 206/219–222
See application file for complete search history.

(56) References Cited

U.S. PATENT DOCUMENTS

| | | | | |
|---|---|---|---|---|
| 5,884,759 | A * | 3/1999 | Gueret | B65D 81/3211 206/222 |
| 6,003,728 | A * | 12/1999 | Elliott | B65D 47/0804 206/219 |
| 7,115,117 | B2 | 10/2006 | Keiji et al. | |
| 9,242,773 | B1 * | 1/2016 | Anderson | B65D 51/2835 |
| 10,773,868 | B2 * | 9/2020 | Maguire | B65D 51/2892 |
| 11,072,489 | B2 * | 7/2021 | Bhat | B65D 85/804 |
| 11,167,895 | B2 * | 11/2021 | Maguire | B65D 51/2892 |
| 2002/0179461 | A1 * | 12/2002 | Mollstam | B65D 47/38 206/222 |
| 2009/0236244 | A1 * | 9/2009 | Frutin | B65D 51/2892 206/219 |
| 2017/0073133 | A1 * | 3/2017 | Presche | B65D 53/06 |

FOREIGN PATENT DOCUMENTS

| | | | |
|---|---|---|---|
| JP | 2006-347574 | A | 12/2006 |
| KR | 10-2009-0025416 | A | 3/2009 |
| KR | 10-2011-0120794 | A | 11/2011 |
| KR | 10-2006825 | B1 | 8/2019 |

* cited by examiner

*Primary Examiner* — Lien M Ngo
(74) *Attorney, Agent, or Firm* — Novick, Kim & Lee, PLLC; Jae Youn Kim; Jihun Kim

(57) ABSTRACT

Proposed herein is a dispenser type beverage container including: a cartridge cover member having a cartridge insertion space into which a cartridge storing a target material to be mixed is inserted; a main body located below the cartridge cover member to contain the target material discharged from the cartridge in an inner space thereof; and a button member of which the inner face of the upper portion capable of doing a rectilinear motion is arranged to meet an end of the cartridge inserted into the cartridge cover member, so that the target material stored in the cartridge is discharged into the main body when the upper portion is pressed down by external pressure.

13 Claims, 8 Drawing Sheets

BEVERAGE CONTAINER OF DISPENSER TYPE

BACKGROUND OF THE INVENTION

Field of the Invention

The present invention relates to a dispenser type beverage container, and more particularly, to a dispenser type beverage container for mixing different ingredients.

Background Art

In general, a container with a specific form, such as a can, a bottle, or a pack, is filled with water or beverage, such as coffee, juice, tea or the like, and is provided in a sealed state. A consumer drinks the beverage after removing a cover of the container.

People take health supplements or various medicinal substances, such as vitamins, red ginseng extract, or various extracts with water or beverage, and recently, blended drinks in which different ingredients are mixed to provide a new flavor is growing in popularity.

With the modernization of society, selling various kinds of functional beverages that people can drink easily, such as coffee, various teas or vitamin drinks, is a growing trend. Consumers take normal drinks by adding desired additives, for instance, vitamin powder, fruit concentrate, coffee concentrate or others, if desired.

Moreover, most of mixed drinks are provided in the form that powder or extract to be mixed is stored in a container in which beverage is contained and a cover is combined with the container.

However, such a conventional mixed beverage container has a limit in that it is impossible to be applicable to other beverage containers since the cover is integrated with the beverage container.

SUMMARY OF THE INVENTION

Accordingly, the present invention has been made to solve the above-mentioned problems occurring in the prior arts, and it is an object of the present invention to provide a dispenser type beverage container which can mix different ingredients rapidly and conveniently when a user pushes a button of a cover of the beverage container.

Technical objects to be achieved by the present invention are not limited to the above-described objects and other technical objects that have not been described will be evidently understood by those skilled in the art from the following description.

To accomplish the above object, according to the present invention, there is provided a dispenser type beverage container including: a cartridge cover member having a cartridge insertion space into which a cartridge storing a target material to be mixed is inserted; a main body located below the cartridge cover member to contain the target material discharged from the cartridge in an inner space thereof; and a button member of which the inner face of the upper portion capable of doing a rectilinear motion is arranged to meet an end of the cartridge inserted into the cartridge cover member, so that the target material stored in the cartridge is discharged into the main body when the upper portion is pressed down by external pressure.

Moreover, the button member includes: a button which does a rectilinear motion in the state where it meets the end of the cartridge inserted into the cartridge cover member; a button support part located below the button and formed to surround a part of a lateral side of the cartridge inserted into the cartridge cover member; and a button cover part which covers the button and the lateral side of the button support part and has a hollow part formed in the middle so that the upper surface of the button is exposed.

Furthermore, the button and the button support part are arranged to be spaced apart from each other at a predetermined interval in a first state, an interval between the button and the button support part gets narrower when the button moves downwards in a second state, and the button is pressed down by external pressure in the second state.

Additionally, the button has an elastic part of which one end is attached onto the outer surface of the button and the other end is located on an upper end portion of the button support part, and the elastic part decreases or increases the interval between the button and the button support part using its elasticity according to the external pressure.

In addition, the dispenser type beverage container further includes an intermediate cover member of which one end is combined with the button member and the other end is combined with the cartridge cover member.

Moreover, the cartridge cover member includes: a cartridge insertion space forming part surrounding a lateral side of the cartridge inserted into the cartridge insertion space; a discharge hole into which the discharge part of the cartridge formed in the middle of the bottom of the cartridge insertion space is inserted; and a wing connection part of which one side is combined with the intermediate cover member and which connects the intermediate cover member with the cartridge insertion space forming part, the wing connection part having a cross sectional area formed in a wing shape based on the cartridge insertion space forming part. The diameter of the discharge hole is smaller than that of the cartridge insertion space forming part.

In another aspect of the present invention, there is provided a dispenser type beverage container including: a cartridge storing a target material to be mixed; a cartridge cover member having a cartridge insertion space into which the cartridge is inserted; a main body located below the cartridge cover member to contain the target material discharged from the cartridge in an inner space thereof; and a button member of which the inner face of the upper portion capable of doing a rectilinear motion is arranged to meet an end of the cartridge inserted into the cartridge cover member, so that the target material stored in the cartridge is discharged into the main body when the upper portion is pressed down by external pressure.

Moreover, the button member includes: a button which does a rectilinear motion in the state where it meets the end of the cartridge inserted into the cartridge cover member; a button support part located below the button and formed to surround a part of a lateral side of the cartridge inserted into the cartridge cover member; and a button cover part which covers the button and the lateral side of the button support part and has a hollow part formed in the middle so that the upper surface of the button is exposed.

Furthermore, the button and the button support part are arranged to be spaced apart from each other at a predetermined interval in a first state, an interval between the button and the button support part gets narrower when the button moves downwards in a second state, and the button is pressed down by external pressure in the second state.

Additionally, the button has an elastic part of which one end is attached onto the outer surface of the button and the other end is located on an upper end portion of the button support part, and the elastic part decreases or increases the interval between the button and the button support part using its elasticity according to the external pressure.

In addition, the cartridge includes: a target material receiving part which receives the target material and of which one end meets one end of the button member and the other end is opened; a discharge part for discharging the target material; and a passage forming part arranged to be inserted into the other end of the target material receiving part, forming a passage according to external pressure in order to discharge the target material contained in the target material receiving part.

Moreover, the passage forming part further includes: a first passage hole providing part having a first passage hole formed in the middle so that the target material passes through the first passage hole; a shield formed at an area of the first passage hole providing part in order to prevent that the target material is discharged to the discharge part; and a second passage hole providing part having a second passage hole through which the target material passing through the first passage hole passes, the second passage hole being inserted into the first passage hole to be movable in a vertical direction and located below the shield. The diameter of the first passage hole is larger than that of the second passage hole providing part.

Furthermore, the first passage hole providing part further comprises a convex part serving as a retaining jaw formed on an inner wall, the second passage hole further comprises a concave part corresponding to the size of the convex part, and the shield is located between the convex part and the concave part.

Additionally, the shield is opened by the top of the second passage hole providing part when an upper portion of the button member is pressed down by external pressure.

In addition, the cartridge is replaceable.

The dispenser type beverage container according to an embodiment of the present invention can mix different ingredients rapidly and conveniently when a user pushes a button of a cover of the beverage container, thereby providing convenience in a mixing process.

Moreover, the dispenser type beverage container according to an embodiment of the present invention can mix the second contents before the use drink beverage without removing the cover of the beverage container storing the first contents therein, thereby preventing decomposition of the mixed beverage.

Furthermore, the dispenser type beverage container storing the first contents therein is recyclable since having an insertion space into which a replaceable cartridge is inserted.

The effects of the present invention are not limited to the above-mentioned effects, and it should be understood that all effects derivable from the components of the invention described in the claims are included in the scope of the present invention.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Figure 1:
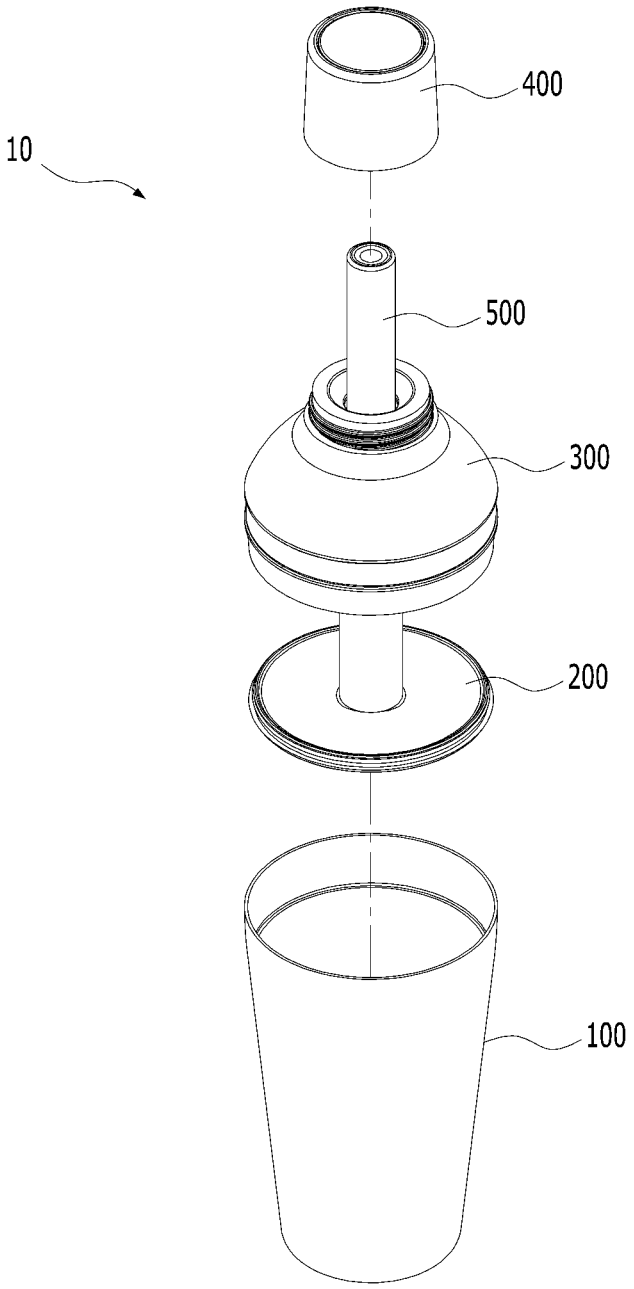
FIG. 1 is an exploded view showing a dispenser type beverage container according to a preferred embodiment of the present invention.

Hereinafter, the present invention will be described in detail with reference to the accompanying drawings. However, embodiments of the present invention may be implemented in several different forms and are not limited to the embodiments described herein. In addition, parts irrelevant to description are omitted in the drawings in order to clearly explain embodiments of the present invention. Similar parts are denoted by similar reference numerals throughout this specification.

Throughout this specification, when a part is referred to as being "connected" to another part, this includes "direct connection" and "indirect connection" via an intervening part. Also, when a certain part "includes" a certain component, other components are not excluded unless explicitly described otherwise, and other components may in fact be included.

The terminology used herein is for the purpose of describing particular embodiments only and is not intended to be limiting of the inventive concept. As used herein, the singular forms "a", "an", and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Hereinafter, the present disclosure will be described in detail with reference to the accompanying drawings.

FIG. 1 is an exploded view showing a dispenser type beverage container according to a preferred embodiment of the present invention.

The dispenser type beverage container according to a preferred embodiment of the present invention includes a main body 100, a cartridge cover member 200, an intermediate cover member 300, and a button member 400.

The dispenser type beverage container according to a preferred embodiment of the present invention may be the beverage container including the main body 100, the cartridge cover member 200, the intermediate cover member 300, and the button member 400, or may be a beverage container including a main body 100, a cartridge cover member 200, an intermediate cover member 300, a button member 400 and a cartridge 500 according to another preferred embodiment of the present invention. In the former case, the cartridge 500 may be an external component.

As shown in FIG. 1, the main body 100 of the dispenser type beverage container 10 can store first liquid contents therein.

The cartridge cover member 200 first covers the main body 100 and provides an insertion space into which the cartridge 500 is inserted.

The intermediate cover member 300 covers the cartridge cover member 200 located therein, so second covers the main body 100. As shown in FIG. 1, the intermediate cover member 300 according to the present invention is curved in the form that the diameter gradually decreases to the top.

The button member 400 is combined with the intermediate cover member 300 and is located at the top end of the dispenser type beverage container 10, and the inner face of an upper portion of the button member 400 may be arranged to meet the top of the cartridge 500.

The button member 400 according to the preferred embodiment of the present invention may be a press button capable of doing a rectilinear motion that the upper portion is pressed downwardly or the pressed upper portion is returned to the original position. The upper portion of the button member 400 is pressed down by external pressure, and a target ingredient (hereinafter, called 'second contents') existing in the cartridge 500 inserted into the cartridge cover member 200 can be discharged into the main body 100.

The cartridge 500 can store the second contents to be mixed with the first contents stored in the main body 100. The cartridge 500 is inserted into the top of the cartridge cover member 200, so that the second contents sealed can be discharged into the main body 100 when a passage is opened by the button member 400.

FIGS. 2A-2D are views showing an operating principle of the dispenser type beverage container in an operation order according to the preferred embodiment of the present invention.

Figure 2A:
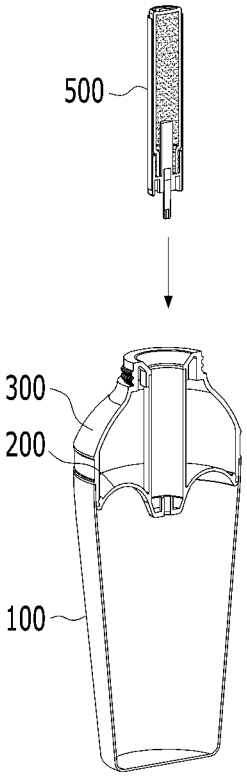
FIGS. 2A-2D are views showing an operating principle of the dispenser type beverage container in an operation order according to the preferred embodiment of the present invention.
Figure 2B:
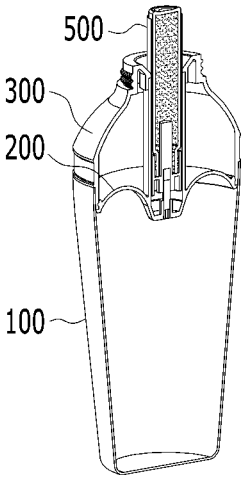

As shown in FIG. 2A, the cartridge 500 storing the second contents therein is inserted into the insertion space formed in the cartridge cover member 200. Therefore, as shown in FIG. 2B, the cartridge 500 is seated in the insertion space.

Figure 2C:
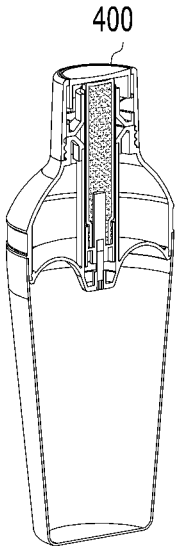

Moreover, as shown in FIG. 2C, the button member 400 is combined with the intermediate member 300, and covers the cartridge 500 and the intermediate cover member 300 in a state where it meets the upper surface of the cartridge 500 seated in the insertion space. That is, the button member 400 serves as a cover of the dispenser type beverage container 10.

Figure 2D:
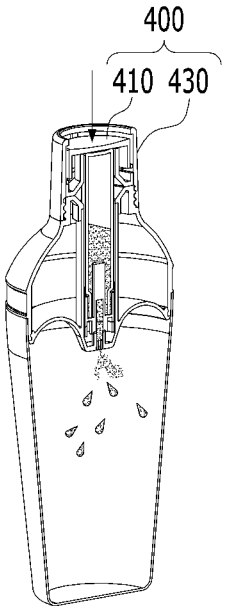

Furthermore, as shown in FIG. 2D, when a user presses the upper surface 410, namely, the button 410, the button 410 is pressed down. Then, the cartridge 500 meeting the button 410 is also pressed down, so that the second contents stored in the cartridge 500 are discharged to the inner space of the main body 100.

Figure 3:
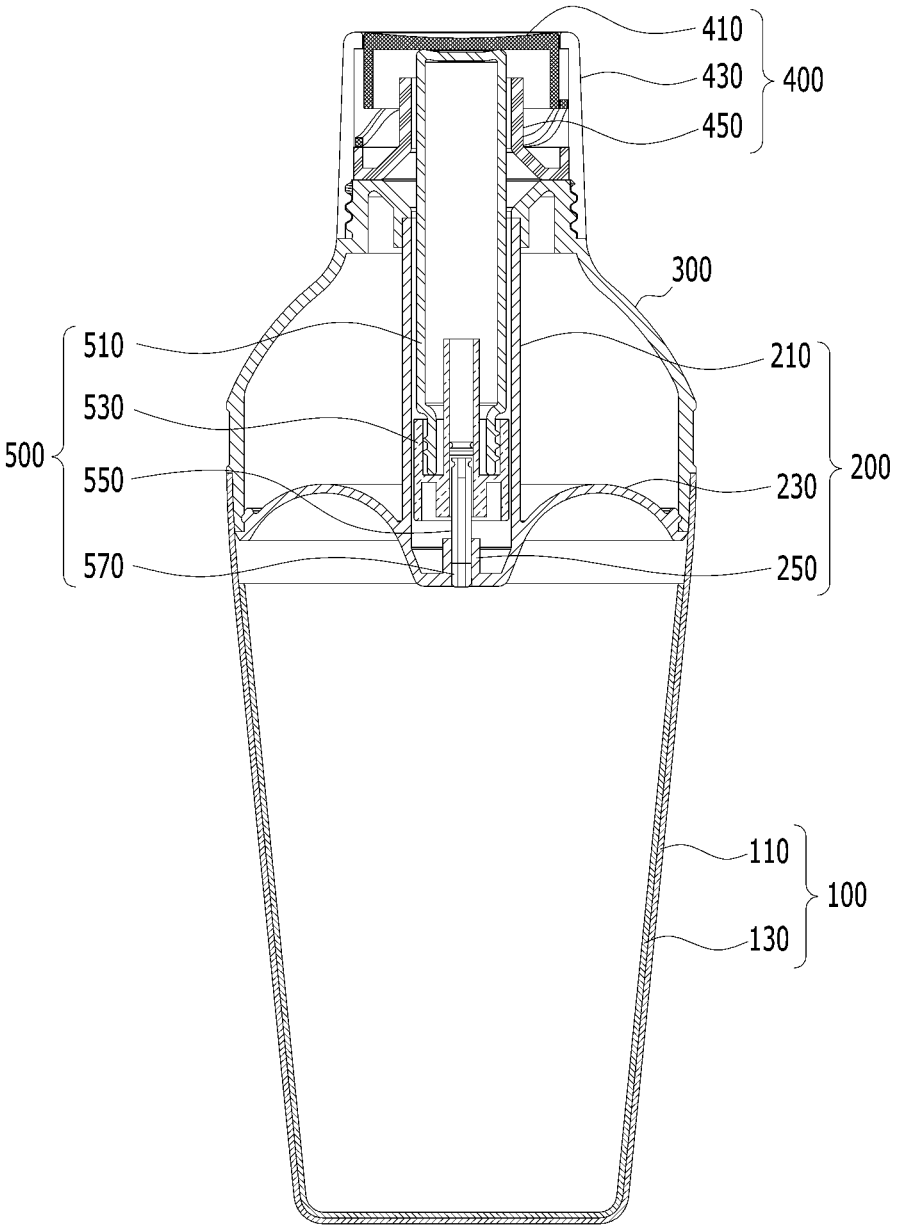
FIG. 3 is a schematically sectional view showing a structure of the dispenser type beverage container according to the preferred embodiment of the present invention.

FIG. 3 is a schematically sectional view showing a structure of the dispenser type beverage container according to the preferred embodiment of the present invention.

The main body 100 according to the preferred embodiment of the present invention includes an outer container 110 and an inner container 130. The inner container 130 may be a container for substantially containing the first contents or the second contents, and may be a container having a space for receiving the outer container 110.

The cartridge cover member 200 includes a cartridge insertion space forming part 210, a wing connection part 230, and a discharge hole 250.

The cartridge insertion space forming part 210 may be formed in the form to surround the lateral side of the cartridge 500 inserted into the insertion space.

Additionally, the wing connection part 230 connects the intermediate cover member 300 with the cartridge insertion space forming part 210, and a cross sectional area of the wing connection part 230 may be formed in a wing shape based on the cartridge insertion space forming part 210.

That is, in more detail, the wing connection part 230 according to the preferred embodiment may be formed in a doughnut shape having the cartridge insertion space forming part 210 formed in the middle when viewed from the top. In addition, the wing connection part 230 is combined with the intermediate cover member 300.

As shown in FIG. 3, the discharge hole 250 is formed at the central portion of the bottom of the cartridge insertion space. A discharge part 570 of the cartridge 500 is inserted into the discharge hole 250.

The intermediate cover member 300 according to the preferred embodiment of the present invention may be arranged in the form that a portion of the bottom of the cartridge cover member 200 is combined with the wing connection part 230 and another portion is combined with the top of the outer container 110.

Referring to FIG. 3, the button member 400 includes a button 410, a button cover part 430, and a button support part 450.

The button 410 can do a rectilinear motion by the user's pressure in the state where it meets the top of the cartridge 500 inserted into the cartridge insertion space of the cartridge cover member 200.

The button cover part 430 covers the button 410 and the side of the button support part 450, and has a hollow part formed in the middle to be exposed to the upper surface of the button 410.

The button support part 450 is located at the lower portion of the button 410, and is formed to surround a portion of the lateral side of the cartridge 500 inserted into the cartridge insertion space. According to the preferred embodiment of the present invention, the button support part 450 is arranged to be supported on the top of the intermediate cover member 300.

The intermediate cover member 300 and the button member 400 will be described later in more detail referring to FIGS. 7 and 8.

The cartridge 500 according to the preferred embodiment of the present invention includes a target material receiving part 510, a passage forming part 530, a second passage hole providing part 550, and the discharge part 570.

The target material receiving part 510 receives the second contents (target material), and has an upper end meeting the inner surface of the button 410 of the button member 400 and a lower end of an opened form.

The passage forming part 530 is arranged at the lower end of the target material receiving part 510 to be inserted into the opened space and has a passage formed by the user's pressure, so that the second contents contained in the target material receiving part 510 can be discharged.

The second passage hole providing part 550 provides a second passage hole, is located to be movable in the passage located in the middle of the passage forming part 530, and moves in the passage formed in the middle of the passage forming part 530 by the user's pressure in order to open a sealed space, so that the second contents can be discharged.

The discharge part 570 connects the main body 100 with the second passage hole providing part 550, and provides a passage that the second contents discharged through the second passage hole by the second passage hole providing part 550 can be discharged into the main body 100.

Figure 4:
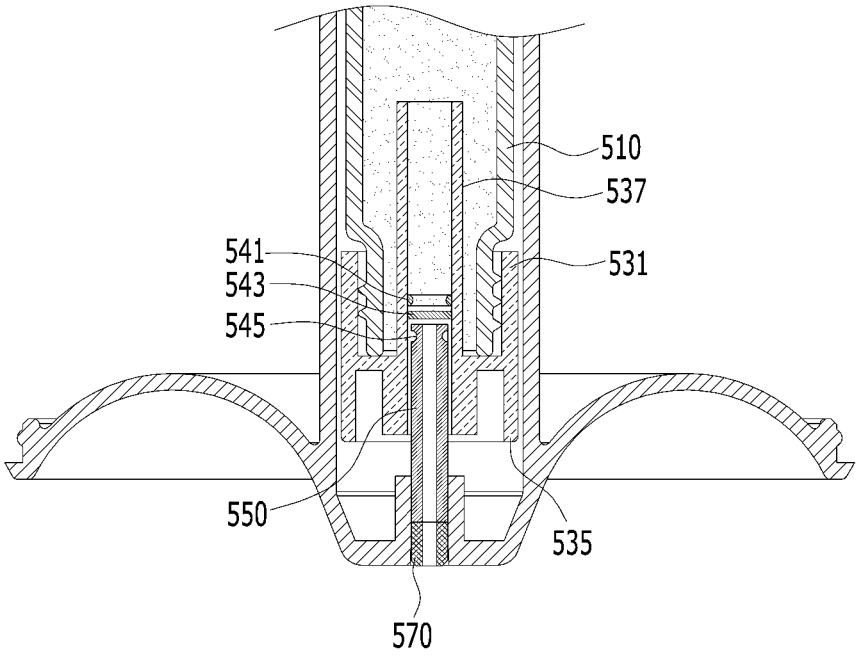
FIGS. 4 and 5 are sectional views showing a cartridge cover member and a cartridge inserted into the cartridge cover member of the dispenser type beverage container according to the preferred embodiment of the present invention.
Figure 5:
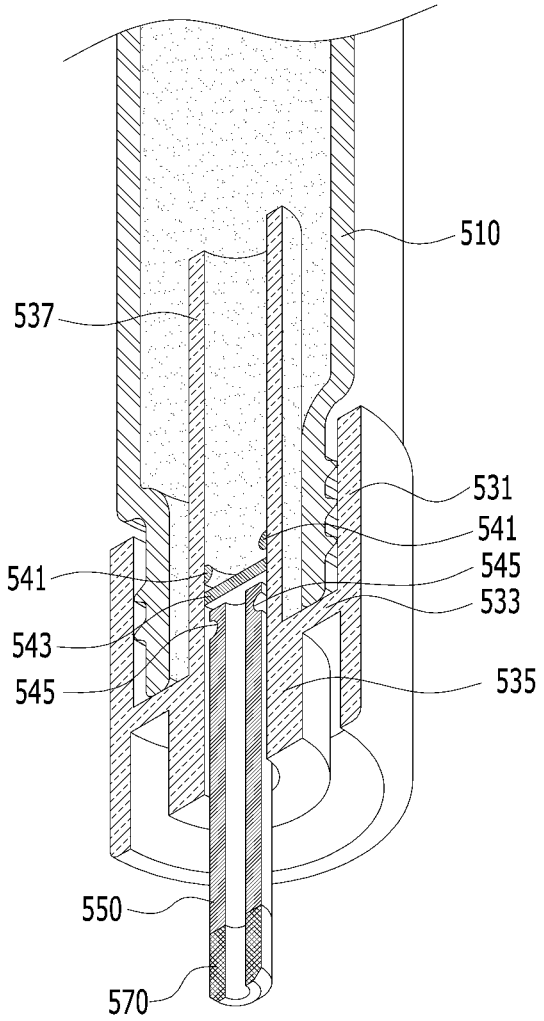

FIGS. 4 and 5 are sectional views showing a cartridge cover member and a cartridge inserted into the cartridge cover member of the dispenser type beverage container according to the preferred embodiment of the present invention.

According to the preferred embodiment of the present invention, the passage forming part 530 includes a second passage hole providing part 550, and a concave part 545. As shown in FIGS. 4 and 5, the second passage hole providing part 550 and the concave part 545 may be formed separately from the passage forming part 530.

Referring to FIGS. 4 and 5, the passage forming part 530 of the cartridge 500 includes an outside wall 531, an intermediate wall 533, an inside wall 535, a first passage hole providing part 537, a convex part 541, and a shield 543.

The diameter of the lower end portion of the target material receiving part 510 is smaller than that of the upper end portion.

Moreover, the outside wall 531 of the passage forming part 530 may be combined with the lower end portion of the target material receiving part 510 by a bolt and a nut. The outside wall 531 has the diameter in the form that the outside wall of the body of the target material receiving part 510 is extended. The intermediate wall 533 is formed in the middle of the length of the outside wall 531 to connect the outside wall 531 with the inside wall 535 and the outside wall 531 with the first passage hole providing part 537. Referring to FIGS. 4 and 5, the lower end portion of the target material receiving part 510 may be combined to meet the upper portion of the intermediate wall 533.

Referring to FIGS. 4 and 5, the inner wall of the inside wall 535 and the inner wall of the first passage hole providing part 537 are connected with each other in an extended form, and the thickness of the inside wall 535 and the thickness of the first passage hole providing part 537 are different from each other. For instance, the inside wall 535 is thicker than the first passage hole providing part 537.

That is, the first passage hole is formed inside the first passage hole providing part 537 and inside the inside wall 535.

The convex part 541 is formed on an area of the inner wall of the first passage hole providing part 537 so as to serve as a retaining jaw relative to the second passage hole providing part 550.

The shield 543 may be located below the convex part 541. For instance, the shield 543 may be made of a weak material, and may be penetrated and opened by the power that the target material receiving part 510 goes down.

The second passage hole providing part 550 forms the second passage hole, and is located to be movable into the first passage hole of the first passage hole providing part 537. That is, the diameter of the second passage hole providing part 550 according to the preferred embodiment of the present invention may be larger than that of the first passage hole.

The second passage hole providing part 550 opens the first passage hole providing part 537 and the sealed space of the target material receiving part 510 by moving upwards from the second passage hole by the user's pressure, so that the second contents contained in the target material receiving part 510 can be discharged in the direction that the discharge part 570 is located.

Furthermore, the second passage hole providing part 550 further includes a concave part 545. The concave part 545 has the size corresponding to the size of the convex part 541 formed on the inner wall of the first passage hole providing part 537, and may be a concave member capable of matching the convex part 541.

According to the preferred embodiment, the shield 543 is located between the convex part 541 and the concave part 545. In more detail, the convex part 541 is spaced apart from the shield 543 at a predetermined interval, and is preferably located above the shield 543. The concave part 545 is spaced apart from the shield 543 at a predetermined interval, and is formed below the shield 543.

Figure 6A:
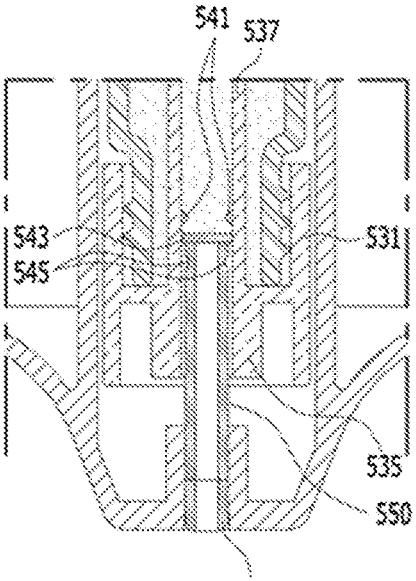
FIGS. 6A and 6B are reference views showing a discharge process of second contents of the cartridge according to the preferred embodiment of the present invention.
Figure 6B:
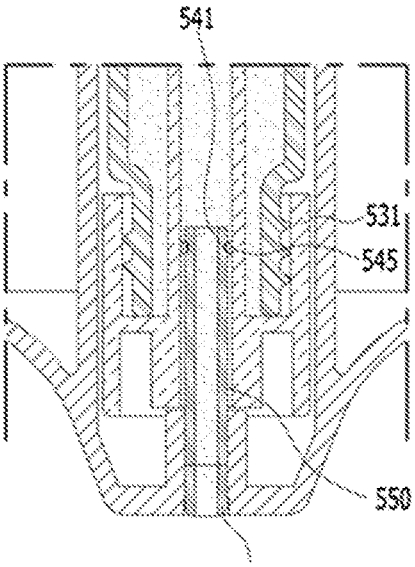

FIGS. 6A and 6B are reference views showing a discharge process of the second contents of the cartridge according to the preferred embodiment of the present invention.

FIG. 6A shows the same state as FIG. 2C. That is, FIG. 6A illustrates a first state where the user does not press the button 410, wherein the second contents in the first state is not discharged to the second passage hole by the shield 543 and keeps the sealed state.

Referring to FIG. 6B, as shown in FIG. 2D, when the user presses the button 410 and the button 410 is pressed downwards, the target material receiving part 510 located to meet the button 410 is also pressed. That is, the shield 543 which is easy to be penetrated by the top of the second passage hole providing part 550 in place is opened by the power that the target material receiving part 510 and the passage forming part 530 go down, so that the second contents sealed are discharged downwardly toward the discharge part 570.

When the first passage hole providing part 537 goes down while the shield 543 is opened, the convex part 541 formed on the inner wall of the first passage hole providing part 537 and the concave part 545 formed on the inner wall of the second passage hole providing part 550 are coupled with each other, so that the target material receiving part 510 and the passage forming part 530 are caught at a predetermined position.

Figure 7:
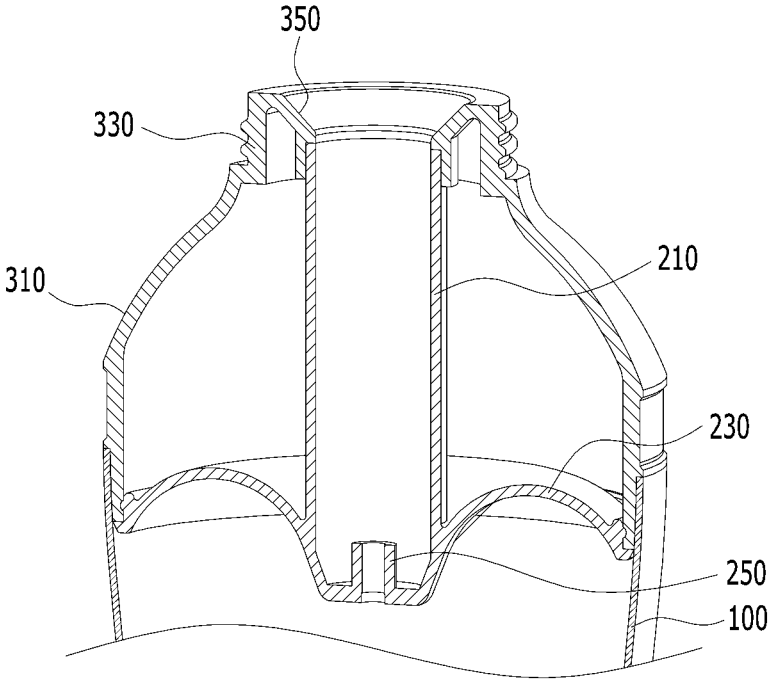
FIG. 7 is a sectional view showing the cartridge cover member and an intermediate cover member according to the preferred embodiment of the present invention.

FIG. 7 is a sectional view showing the cartridge cover member and the intermediate cover member according to the preferred embodiment of the present invention.

Referring to FIG. 7, the intermediate cover member 300 according to the preferred embodiment further includes a curve part 310, a coupling part 330, and an insertion guide part 350.

The curve part 310 is curved in the form that the diameter gradually decreases to the top.

Furthermore, the coupling part 330 is extended to the curve part 310, and has a convex groove coupled with the button cover part 430 of the button member 400.

Additionally, the insertion guide part 350 is extended to the button cover part 430, and is formed to be adjacent to the outer face of the upper portion of the insertion space forming part 210 to guide an insertion route of the cartridge inserted into the insertion space forming part 210.

Figure 8:
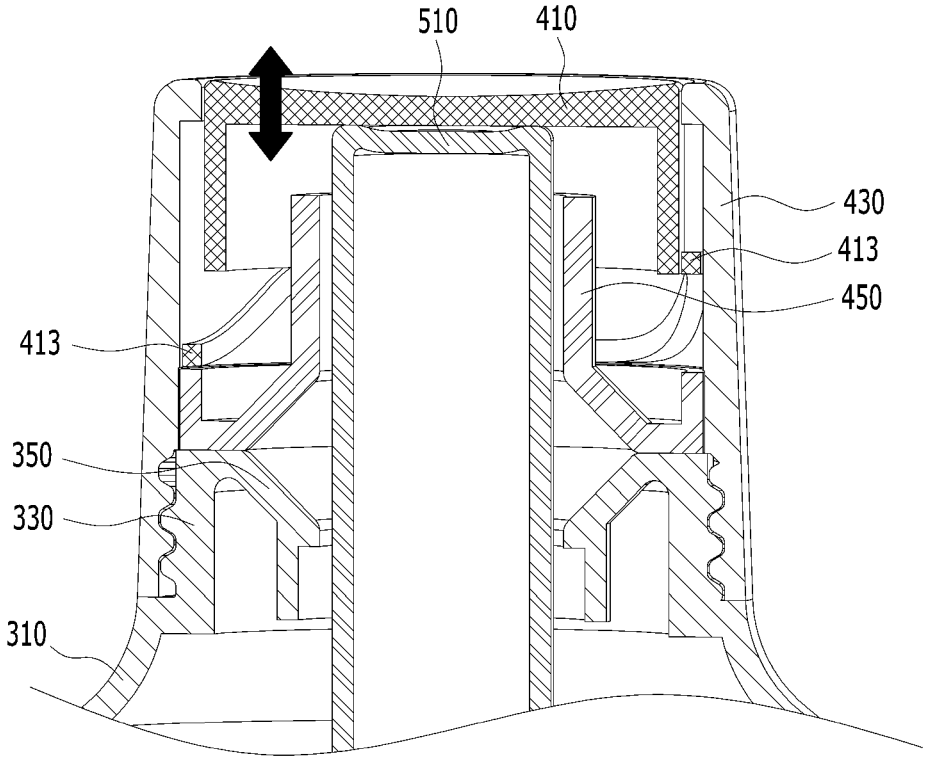
FIG. 8 is a concretely sectional view of a button member according to the preferred embodiment of the present invention.

FIG. 8 is a concretely sectional view of the button member according to the preferred embodiment of the present invention.

As shown in FIG. 8, the button 410 and the button support part 450 in the first state, namely, in the state before the button is pressed, are arranged to be spaced apart from each other at a predetermined interval. Not shown in the drawing, the interval between the button 410 and the button support part 450 gets narrower than the first state when the button 410 moves downwards in the second state, namely, in the state where the button is pressed.

Figure 9A:
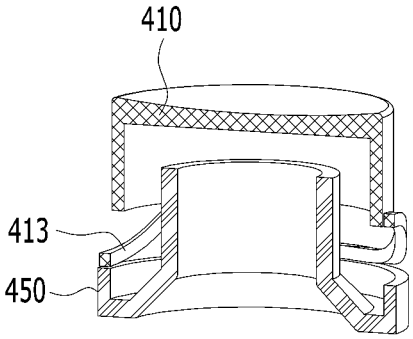
FIGS. 9A and 9B are reference views showing a button and a button support part according to the preferred embodiment of the present invention.
Figure 9B:
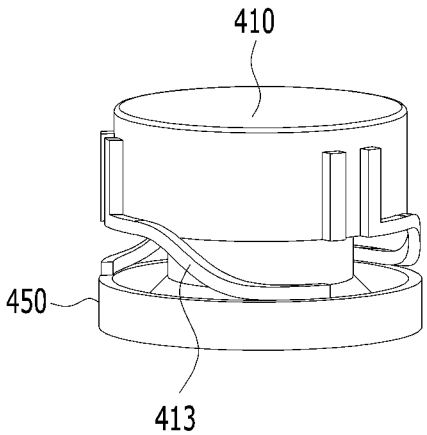

FIGS. 9A and 9B are reference views showing a button and a button support part according to the preferred embodiment of the present invention.

Referring to FIGS. 9A and 9B, the button 410 may further include at least one elastic part 413. The elastic part 413 may be attached on the outer surface of the button 410.

In more detail, one end of the elastic part 413 is attached to the outer surface of the button 410 and the other end is located on the upper end portion of the button support part 450.

When the user presses the button 410, the elastic part 413 can narrow the interval between the button 410 and the button support part 450 using elasticity generated by pressure transferred from the button 410. For instance, the elastic part 413 is made of a material with excellent elasticity, for instance, rubber, synthetic resin, spring or the like, and can reduce the original height of the elastic part 413 through elastic deformation by external pressure.

The cartridge 500 according to the preferred embodiment may be a replaceable container or a disposable container. Moreover, the beverage containers 100 to 400 can recycled since the cartridge 500 has the insertion space.

The above description of the present disclosure is just for illustration, and a person skilled in the art will understand that the present disclosure can be easily modified in different ways without changing essential techniques or features of the present disclosure. Therefore, the above embodiments should be understood as being descriptive, not limitative. For example, any component described as having an integrated form may be implemented in a distributed form, and any component described as having a distributed form may also be implemented in an integrated form.

The scope of the present disclosure is defined by the appended claims, rather than the above description, and ail changes or modifications derived from the meaning, scope and equivalents of the appended claims should be interpreted as falling within the scope of the present disclosure.

What is claimed is:

1. A beverage container comprising:

a cartridge cover assembly having a cartridge insertion space into which a cartridge storing a target material to be mixed is to be inserted;

a main body disposed below the cartridge cover assembly to contain the target material discharged from the cartridge in an inner space thereof; and a button member configured to move rectilinearly and having an upper portion, wherein an inner face of the upper portion is arranged to meet an end of the cartridge inserted into the cartridge cover assembly, so that the target material stored in the cartridge is discharged into the main body when the upper portion is pressed down by external pressure, wherein the button member comprises:

a button configured to move rectilinearly when the button meets the end of the cartridge inserted into the cartridge cover assembly;

a button support disposed below the button and surrounding a part of a lateral side of the cartridge inserted into the cartridge cover assembly; and a button cover covering the button and a lateral side of the button support and having a hollow formed therethrough so that an upper surface of the button is exposed.

2. The beverage container according to claim 1, wherein the button and the button support are arranged to be spaced apart from each other at an interval, and wherein the interval between the button and the button support gets narrower when the button moves downwards as the button is pressed down by the external pressure.

3. The beverage container according to claim 2, wherein the button has an elastic protrusion having one end disposed on an outer surface of the button and another end disposed on an upper end portion of the button support, and wherein the elastic protrusion decreases or increases the interval between the button and the button support using its elasticity according to the external pressure.

4. The beverage container according to claim 1, further comprising:

an intermediate cover having one end combined with the button member and another end combined with the cartridge cover assembly.

5. The beverage container according to claim 4, wherein the cartridge cover assembly comprises:

a cartridge insertion space forming wall surrounding the lateral side of the cartridge inserted into the cartridge insertion space;

a discharge hole formed in a middle of a bottom of the cartridge cover assembly, wherein a discharge nozzle of the cartridge is inserted into the discharge hole; and a wing having one side combined with the intermediate cover and connecting the intermediate cover with the cartridge insertion space forming wall, the wing having a cross sectional area formed in a wing shape, and wherein a diameter of the discharge hole is smaller than that of the cartridge insertion space forming wall.

6. A beverage container comprising:

a cartridge storing a target material to be mixed;

a cartridge cover assembly having a cartridge insertion space into which the cartridge is inserted;

a main body disposed below the cartridge cover assembly to contain the target material discharged from the cartridge in an inner space thereof; and a button member configured to move rectilinearly and having an upper portion, wherein an inner face of the upper portion is arranged to meet an end of the cartridge inserted into the cartridge cover assembly, so that the target material stored in the cartridge is discharged into the main body when the upper portion is pressed down by external pressure, wherein the button member comprises:

a button configured to move rectilinearly when the button meets the end of the cartridge inserted into the cartridge cover assembly;

a button support disposed below the button and surrounding a part of a lateral side of the cartridge inserted into the cartridge cover assembly; and a button cover covering the button and a lateral side of the button support and having a hollow formed therethrough so that an upper surface of the button is exposed.

7. The beverage container according to claim 6, wherein the button and the button support are arranged to be spaced apart from each other at an interval, and wherein the interval between the button and the button support gets narrower when the button moves downwards as the button is pressed down by the external pressure.

8. The beverage container according to claim 7, wherein the button has an elastic protrusion having one end disposed on an outer surface of the button and another end disposed on an upper end portion of the button support, and wherein the elastic protrusion decreases or increases the interval between the button and the button support using its elasticity according to the external pressure.

9. A beverage container comprising:

a cartridge storing a target material to be mixed;

a cartridge cover assembly having a cartridge insertion space into which the cartridge is inserted;

a main body disposed below the cartridge cover assembly to contain the target material discharged from the cartridge in an inner space thereof; and a button member configured to move rectilinearly and having an upper portion, wherein an inner face of the upper portion is arranged to meet an end of the cartridge inserted into the cartridge cover assembly, so that the target material stored in the cartridge is discharged into the main body when the upper portion is pressed down by external pressure, wherein the cartridge comprises:

a target material receiving container configured to receive the target material and having one end for meeting one end of the button member and another end being opened;

a discharge nozzle for discharging the target material; and a passage forming cap arranged to be inserted into the another end of the target material receiving container to form a passage according to the external pressure in order to discharge the target material contained in the target material receiving container.

10. The beverage container according to claim 9, wherein the passage forming cap comprises:

a first passage hole providing tube having a first passage hole formed therein so that the target material passes through the first passage hole;

a shield disposed in the first passage hole to prevent the target material from being discharged to the discharge nozzle; and a second passage hole providing tube having a second passage hole formed therein so that the target material having passed through the first passage hole passes through the second passage hole, the second passage hole providing tube being inserted into the first passage hole providing tube to be movable in a longitudinal direction of the first passage hole providing tube and located below the shield, and wherein a diameter of the first passage hole is larger than that of the second passage hole providing tube.

11. The beverage container according to claim 10, wherein the first passage hole providing tube further comprises a convex part serving as a retaining jaw formed on an inner wall thereof, wherein the second passage hole providing tube further comprises a concave part corresponding to the convex part, and wherein the shield is located between the convex part and the concave part.

12. The beverage container according to claim 10, wherein the shield is opened by a top of the second passage hole providing tube when the upper portion of the button member is pressed down by the external pressure.

13. The beverage container according to claim 6, wherein the cartridge is replaceable.

* * * * *